US008708472B2

(12) United States Patent
Ohnishi

(10) Patent No.: US 8,708,472 B2
(45) Date of Patent: Apr. 29, 2014

(54) DAMPER APPARATUS, DAMPER TUBE ASSEMBLY, AND INK JET PRINTER

(75) Inventor: Masaru Ohnishi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 137 days.

(21) Appl. No.: 13/485,921

(22) Filed: Jun. 1, 2012

(65) Prior Publication Data

US 2012/0306975 A1 Dec. 6, 2012

(30) Foreign Application Priority Data

Jun. 2, 2011 (JP) ..... 2011-124006

(51) Int. Cl.
*B41J 2/17* (2006.01)

(52) U.S. Cl.
USPC ..... 347/94

(58) Field of Classification Search
USPC ..... 347/94
See application file for complete search history.

(56) References Cited

U.S. PATENT DOCUMENTS 7,303,271 B2 * 12/2007 Shimizu et al. ..... 347/94
2006/0279604 A1 * 12/2006 Ueda et al. ..... 347/36

FOREIGN PATENT DOCUMENTS

JP 11-020144 1/1999
JP 2009-178889 8/2009

* cited by examiner

*Primary Examiner* — Jannelle M Lebron
(74) *Attorney, Agent, or Firm* — Jianq Chyun IP Office

(57) ABSTRACT

The invention provides a damper apparatus including a housing having a valve chamber and reciprocally moving integrally with a carriage, an inlet port communicating an ink flow channel on the upstream side and the valve chamber, an outlet port communicating the ink flow channel on the downstream side and the valve chamber, and a spherical valve body stored so as to be movable in the valve chamber, wherein the valve body moves relatively to a position for closing the inlet port or the outlet port upon reception of the inertial force in association with the acceleration and deceleration to close the ink flow channel when the carriage is accelerated or decelerated, and the valve body moves relatively to a position for opening the inlet port and the outlet port under its own weight to open the ink flow channel when the carriage is not accelerated and decelerated.

5 Claims, 11 Drawing Sheets

DAMPER APPARATUS, DAMPER TUBE ASSEMBLY, AND INK JET PRINTER

CROSS-REFERENCE TO RELATED APPLICATIONS

This application claims the priority benefit of Japan application serial no. 2011-124006, filed on Jun. 2, 2011. The entirety of the above-mentioned patent application is hereby incorporated by reference herein and made a part of this specification.

BACKGROUND OF THE INVENTION

1. Technical Field

The present invention relates to a damper apparatus configured to open and close an ink channel connecting an ink tank and a printer head, a damper tube assembly, and an ink jet printer.

2. Description of the Related Art

An ink jet printer is an apparatus configured to draw information such as characters, graphics, patterns, images on a surface of an object to be printed by discharging ink droplets on a printing medium from nozzles of a printer head while moving the printer head formed generally with a number of nozzles reciprocally with respect to the printing medium. In the ink jet printer in this configuration, for example, a cartridge-type ink tank is mounted on the side of a printer body, and ink stored in the ink tank is supplied to a printer head via a flexible ink tube. When the printer head moves reciprocally with respect to the printing medium for a printing operation, part of the ink tube connected to the printer head (the downstream side of the ink tube) is moved at the same velocity as the printer head. Therefore, in the reciprocal motion of the printer head, in accelerating and decelerating areas where the direction of movement is inverted, an inertial force in the direction of travel or in the direction opposite therefrom acts on the ink itself accumulated in the ink tube. When the inertial force causes the pressure in the ink tube to vary according to the self-weight of the ink and the internal pressure of the head is significantly pressurized, "dripping" of ink, that is, ejection of large ink drop from a nozzle of the printer head occurs. In contrast, when the internal pressure of the printer head is significantly reduced, a meniscus formed in the nozzle is broken, and an air bubble is sucked into the printer head, which may cause an ink undischarged phenomenon that the discharge of ink is disabled (also referred to as "nozzle skip") may occur. Accordingly, in order to inhibit the pressure variations in the printer head, various types of damper apparatuses to be provided at a midpoint of the ink tube are proposed and put into practical application in the related art (for example, see JP-A-11-20144).

The damper apparatus of the related art includes a rectangular box-shaped housing communicating with the ink tube and opening at one end surface thereof, and a flexible damper film configured to cover an opening surface of the housing, so that the damper film is deflected outward or inward according to the pressure variations of the ink, thereby changing the capacity of the damper chamber formed in the interior of the housing and absorbing the pressure variation. However, the damper apparatus of this type has a problem in that the damping function (pressure inhibiting function) varies depending on an initial state of the damper chamber. For example, even though the ink pressure acts on the pressurizing side when the damper film is deflected outward and the damper chamber is expanded to the maximum, the capacity in the damper chamber is not increased any longer, and hence the damping function does not work. In contrast, even though the ink pressure acts on the depressurizing side when the damper film is deflected inward and the damper chamber is in the contracted state, the capacity of the damper chamber is not reduced any longer, and hence the damping function does not work as well in this case as well. As described above, in the damper apparatus having the configuration of the related art, when the carriage is accelerated and decelerated in association with the reciprocal motion thereof, and the ink pressure variations occur in the pressurizing or depressurizing direction in the printer head correspondingly, the damping function may not work sufficiently.

SUMMARY OF THE INVENTION

In view of such problems, it is an object of the present invention to provide a damper apparatus configured to be capable of closing an ink flow channel reliably when a carriage is accelerated or decelerated in association with a reciprocal motion thereof and a damper tube assembly and an ink jet printer having the same.

In order to solve the above-described object, according to a first aspect of the invention, there is provided a damper apparatus provided at a midpoint of an ink flow channel connecting an ink tank having ink stored therein and a printer head and configured to open and close the ink flow channel in an ink jet printer having the printer head configured to discharge ink on a printing medium and a carriage configured to move reciprocally along a predetermined scanning direction, the damper apparatus comprising: a housing having a valve chamber communicating with the ink flow channel in an interior of the housing and reciprocally moving integrally with the carriage; an inlet port formed at one end portion of the housing and configured to communicate the ink flow channel on a side of the ink tank and the valve chamber; an outlet port formed at an other end portion of the housing and configured to communicate the ink flow channel on a side of the printer head and the valve chamber; and a valve body (for example, a spherical valve body 130 in this embodiment) configured to be stored so as to be relatively movable in the valve chamber, wherein the valve body moves relatively to a position for closing selectively the inlet port or the outlet port according to a direction of action of an inertial force upon reception of the inertial force in association with an acceleration and deceleration to close the ink flow channel when the carriage is accelerated or decelerated, and the valve body moves relatively to a position for opening selectively the inlet port or the outlet port under an own weight of the valve body to open the ink flow channel when the carriage is not accelerated and decelerated.

Preferably, a bottom surface of the valve chamber comprises a deepest portion below a center position between the inlet port and the outlet port and an inclination or a curve having extending downward to the deepest portion from the inlet port and the outlet port, and the valve body is formed of a rotating member which is capable of rolling on the bottom surface.

Preferably, the valve body is hung from a top surface of the valve chamber in a suspended state so as to be swingable with a supporting member, and is configured to perform a pendulum motion upon reception of an action of an inertial force and a gravitational force in association with a reciprocal motion of the carriage, and the inlet port and the outlet port are arranged on a swinging trajectory of the valve body due to the pendulum motion.

In order to solve the above-described object, a damper tube assembly according to a second aspect of the invention is the damper apparatus having the configuration described above, and at least one of an upstream side tube connected to the inlet port and capable of forming the ink flow channel on the side of the ink tank and a downstream side tube connected to the outlet port and capable of forming the ink flow channel on the side of the printer head.

In order to solve the above-described object, there is provided an ink jet printer according to the third aspect of the invention including: a medium supporting portion (for example, a platen 20 in the embodiment) configured to support a printing medium; a carriage having a printer head configured to discharge ink; a carriage moving mechanism configured to relatively move the carriage along a surface to be printed of the printing medium supported by the medium supporting portion; an ink tank configured to store ink; an ink tube configured to form an ink flow channel configured to connect the ink tank and the printer head; and the damper apparatus having the configuration as described above.

According to the damper apparatus according to the first aspect of the invention, the damper apparatus which moves integrally with the carriage and the damper apparatus is provided at a midpoint of the ink flow channel which connects the ink tank and the printer head to cause the valve body of the damper apparatus to sense the acceleration and deceleration generated in association with the reciprocal motion of the carriage and, when the carriage is accelerated or decelerated, the valve body selectively displaced to a position closing the inlet port or the outlet port in accordance with the inertial law, so that the pressure variations in the printer head is inhibited, and the ink dripping phenomenon and the ink undischarged phenomenon may be prevented, and hence improvement of the printing quality is achieved. In contrast, when the carriage is not in acceleration and deceleration, the valve body is displaced to a position opening the inlet port and the outlet port by the action of the gravitational force to open the ink flow channel. Therefore, the ink from the ink tank can be supplied to the printer head through the ink flow channel without delay according to the discharge of ink.

In the damper apparatus having the configuration as described above, a bottom surface of the valve chamber includes an inclination or a curve having the deepest portion below the center position between the inlet port and the outlet port and extending downward to the deepest portion from the inlet port and the outlet port, and the valve body is formed of a rotating member which is capable of rolling on the bottom surface. Therefore, the valve body rolls along the bottom surface of the valve chamber in accordance with the inertial law and is selectively displaced to the position closing the inlet port or the outlet port according to the direction of the action of the inertial force to close the ink flow channel when the carriage is accelerated or decelerated. In contrast, when the carriage is not accelerated or decelerated, the valve body rolls downward on the bottom surface of the valve chamber by the action of the gravitational force, and displaced to the position opening the inlet port and the outlet port to open the ink flow channel. Therefore, since the ink flow channel can be opened and closed with the simple configuration that the valve body is caused to roll between the respective ports and the deepest portion by the action of the inertial force and the gravitational force to cause the valve body to positions closing and opening the respective ports, reduction of the number of components, reduction in size and weight, and cost reduction are achieved.

Also, the valve body is hung from the top surface of the valve chamber in the suspended state so as to be swingable with the supporting member, and is configured to perform the pendulum motion upon reception of the action of the inertial force and the gravitational force in association with the reciprocal motion of the carriage, and the inlet port and the outlet port are arranged on the swinging trajectory of the valve body of the pendulum motion, so that the valve body performs the pendulum motion in the valve chamber in accordance with the inertial law and is selectively displaced to a position closing the inlet port or the outlet port according to the direction of the action of the inertial force to close the ink flow channel when the carriage is accelerated or decelerated. In contrast, when the carriage is not accelerated or decelerated, the valve body remains standstill in the suspended state in the valve chamber by the action of a gravitational force, and opens the inlet port and the outlet port to open the ink flow channel. Therefore, since the ink flow channel can be opened and closed with a simple structure that the valve body is caused to perform the pendulum motion between the respective ports by the action of the inertial force and the gravitational force to be displaced between positions of closing and opening the respective ports, reduction of the number of component, reduction in size and weight, and cost reduction are achieved. In addition, since the valve body needs not to be rolled on the bottom surface, the abrasion caused by a contact between the valve body and the bottom surface does not occur on the valve body, so that occurrence of the seat-contact failure between the valve body and the seat surface formed in the periphery of the respective ports by the deformation of the valve body caused by abrasion with time is prevented.

The damper tube assembly according to the second aspect of the invention is the damper apparatus having the configuration described above, and at least one of the upstream side tube connected to the inlet port and capable of forming the ink flow channel on the side of the ink tank and the downstream side tube connected to the outlet port and capable of forming the ink flow channel on the side of the printer head. Therefore not only the same operational effects as described above are obtained, but also the assembly workability between the damper apparatus and the ink tube in the ink jet printer may be improved.

According to the ink jet printer in the third aspect of the invention, there is provided the ink jet printer including: the medium supporting portion configured to support the printing medium; the carriage having the printer head configured to discharge ink; the carriage moving mechanism configured to relatively move the carriage along the surface to be printed of the printing medium supported by the medium supporting portion; the ink tank configured to store ink; the ink tube configured to form the ink flow channel configured to connect the ink tank and the printer head; and the damper apparatus having the configuration described above. Therefore, for example, not only the same operational effects as described above is obtained, but also the more the velocity of acceleration and deceleration is increased, the larger inertial force acts, and hence the response of the valve body is improved and the respective ports are firmly closed. Therefore, further increase in velocity of the reciprocal motion of the carriage, that is, the increase in velocity of printing is also possible.

DESCRIPTION OF THE PREFERRED EMBODIMENTS

Figure 1:
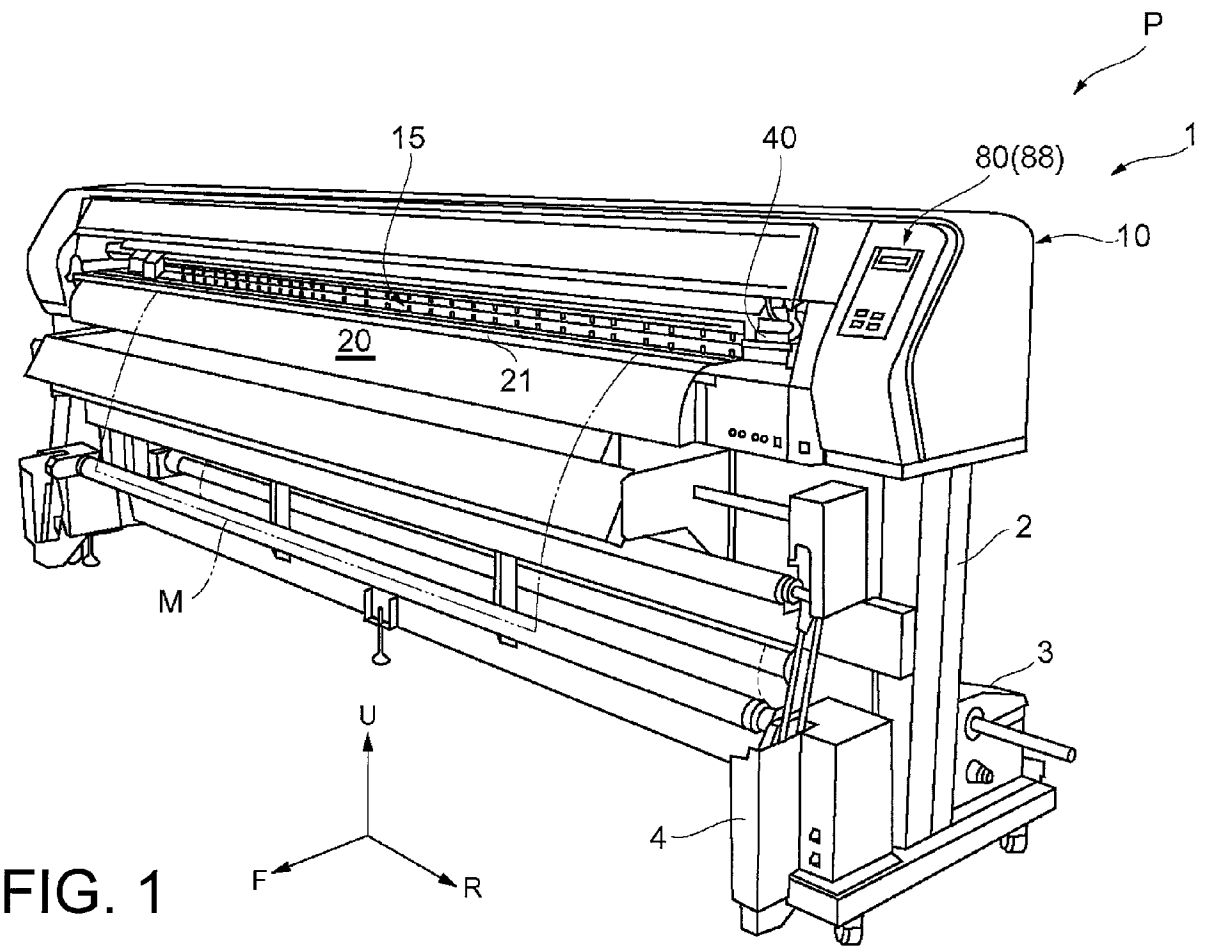
FIG. 1 is a perspective view showing a printer apparatus according to the invention viewed obliquely from the front.
Figure 2:
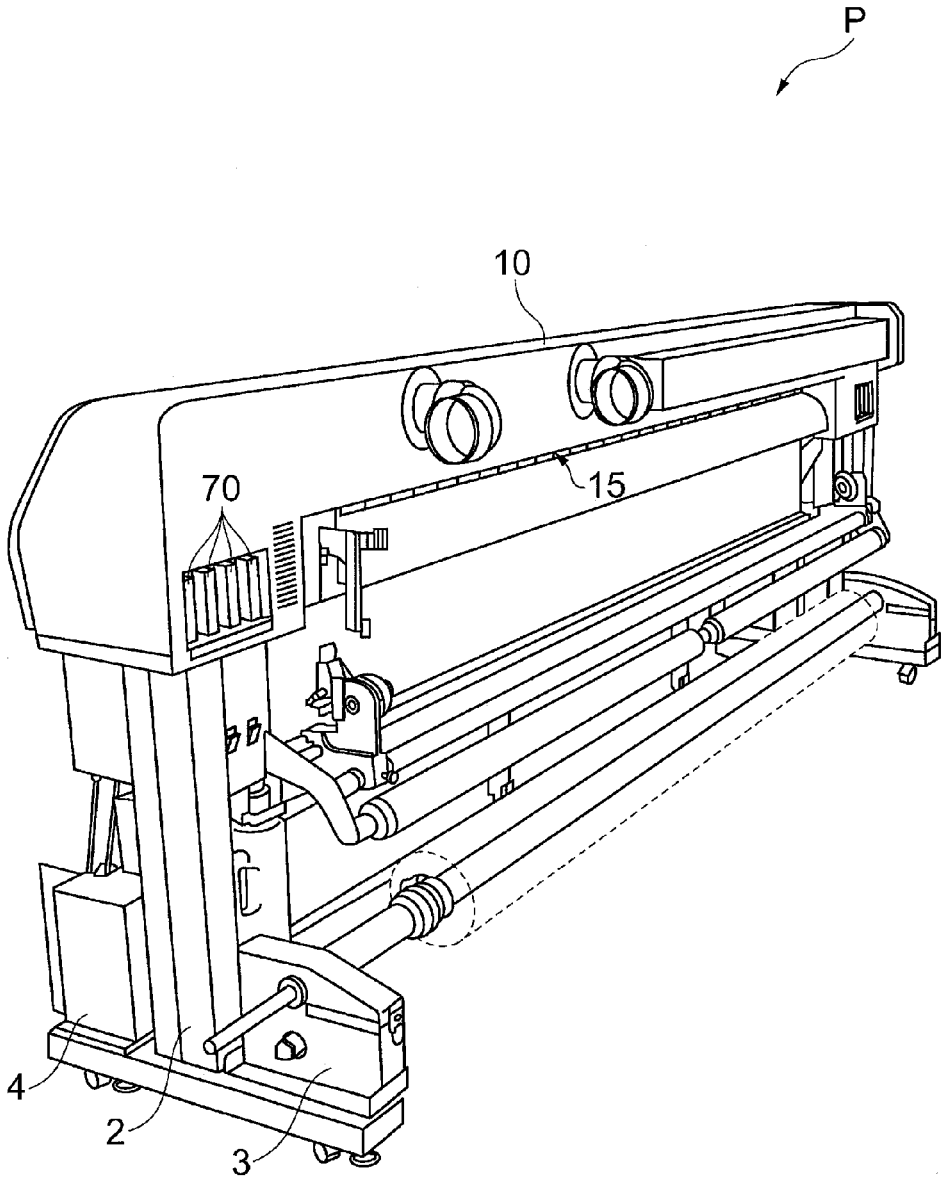
FIG. 2 is a perspective view showing the printer apparatus viewed obliquely from the rear.
Figure 3:
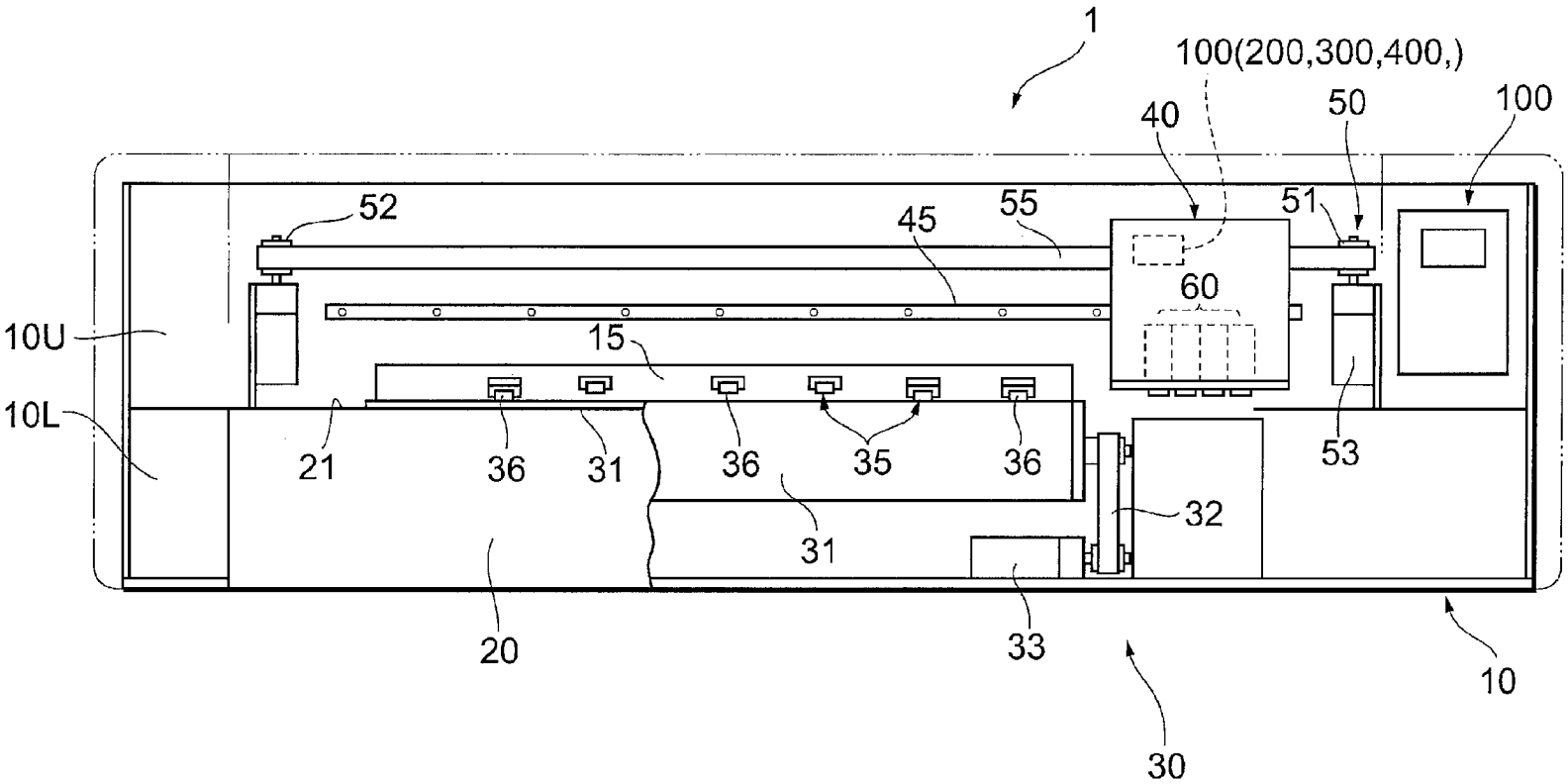
FIG. 3 is a front view showing a configuration of a principal portion of an apparatus body which constitutes the printer apparatus.

Referring now to the attached drawings, a mode of preferable embodiment of the invention will be described. As an example of an ink jet printer according to the invention (hereinafter, referred to as a printer apparatus), a perspective view of a printer apparatus P of a type in which a printing medium moves along one of two orthogonal axes along a surface of an object to be printed and a printer head moves along the other axis viewed obliquely from the front is shown in FIG. 1, a perspective view of the same viewed obliquely from the rear is shown in FIG. 2, and a configuration of a principal portion of an apparatus body 1 in the printer apparatus P is shown in FIG. 3. First of all, referring to these drawings, a general configuration of the printer apparatus P will be described in brief. In the following description, directions indicated by arrows F, R, and U shown in FIG. 1 are referred to as front, right and up respectively.

The printer apparatus P includes the laterally elongated box-shaped apparatus body 1 configured to perform a printing process such as characters or graphics on a surface to be printed of a sheet-shaped printing medium M such as a PVC sheet or the like, which are referred to as "media", a supporting portion 2 configured to support the apparatus body 1 at a height position which facilitates an operation, a feeding mechanism 3 provided on the back side of the supporting portion 2 to feed the unprocessed printing medium M wound in a roll shape to the apparatus body 1, and a winding mechanism 4 provided on the front side of the supporting portion 2 to wind the printing medium M after the completion of printing.

The apparatus body 1 includes a laterally elongated window-shaped media inserting portion 15 configured to allow insertion of the printing medium M in the fore-and-aft direction at a vertical intermediate portion of a frame 10 which forms a frame structure. Provide on a lower frame 10L positioned below the media inserting portion 15 are a platen 20 configured to support the printing medium M and a medium moving mechanism 30 configured to cause the printing medium M supported by the platen 20 to be moved in the fore-and-aft direction. Provided on an upper frame 10U positioned on the upper side of the media inserting portion 15 is a carriage 40 configured to hold a printer head 60 and a carriage moving mechanism 50 configured to move the carriage 40 in the lateral direction. The apparatus body 1 is provided with a control unit 80 configured to control operations of respective parts of the printer apparatus P such as a fore-and-aft movement of the printing medium M by the medium moving mechanism 30, a left-and-right movement of the carriage 40 by the carriage moving mechanism 50, and discharge of ink by the printer head 60, and an operating panel 88 is disposed on a front surface of the apparatus body 1.

The platen 20 is provided on the lower frame 10L so as to extend in the fore-and-aft direction on the lower side of the media inserting portion 15, and a medium supporting portion 21 configured to support the printing medium M in the horizontal direction is formed in a lateral band-shaped drawing area for the printer head 60.

The medium moving mechanism 30 includes a cylindrical feeding roller 31 disposed so as to expose an upper peripheral surface from the platen 20 extending in the lateral direction and a roller driving motor 33 configured to drive the feeding roller 31 to rotate via a timing belt 32. Plural roller assemblies 35 each having a pinch roller 36 rotatable forward and backward are arranged in a line in the lateral direction above the feeding roller 31. The roller assemblies 35 are configured to be displaced between a clamping position in which the pinch rollers 36 are pressed against the feeding roller 31 and an unclamping position in which the pinch rollers 36 are apart from the feeding roller 31. When the roller driving motor 33 is driven to rotate in a state in which the roller assemblies 35 are set to the clamping position and the printing medium M is clamped between the pinch rollers 36 and the feeding roller 31, the printing medium M is transported in the fore-and-aft direction by a feeding amount according to the angle of rotation of the feeding roller 31 (the drive control value output from the control unit 80). In FIG. 3, both of the state in which the roller assemblies 35 are set to the clamping position and the state in which the roller assemblies 35 are set to the unclamping position are illustrated.

The carriage 40 is supported by a guide rail 45 extending in parallel to the feeding roller 31 and attached to the upper frame 10U via a slide block, not shown, so as to be movable in the lateral direction, and is driven by the carriage moving mechanism 50, described below. The carriage 40 includes the printer head 60 and a damper apparatus 100 mounted thereon, and moves integrally with the carriage 40 in the lateral direction.

The carriage moving mechanism 50 includes a drive pulley 51 and a driven pulley 52 provided on the left and right sides of the frame 10 with the intermediary of the guide rail 45, a carriage driving motor 53 configured to drive and rotate the drive pulley 51, and a timing belt 55 in the form of an endless belt wound between the drive pulley 51 and the driven pulley 52. The carriage 40 is fixedly coupled to the timing belt 55, and the carriage 40 supported by the guide rail 45 is moved in the lateral direction above the platen 20 by an amount of movement according to the angle of rotation of the carriage driving motor 53 (the drive control value output from the control unit 80) by driving and rotating the carriage driving motor 53. The carriage 40 moves reciprocally in the lateral direction in a scanning area on the platen 20, is accelerated and decelerated at left and right ends (turning points) of the scanning area, and is driven at a uniform velocity in a drawing area in the intermediate section thereof (detailed description will be given below with reference to the drawings) on the basis of the control of the control unit 80.

The printer head 60 generally includes plural printer heads corresponding to the number of the types of ink used in the printer apparatus P arranged in the lateral direction and, for example, includes four printer heads 60 corresponding to the respective ink types of basic four colors of cyan (C), magenta (M), yellow (Y), and black (K), and the respective printer heads 60 are disposed equidistantly in a line along the scanning direction of the carriage 40 (lateral direction). Hereinafter, description of the printer heads 60 is given for one of the four printer heads 60 for the sake of simplicity of description unless expression in plurality is needed. Formed on a lower surface of the printer head 60 is a nozzle surface (not shown) which is capable of discharging ink downward, and the nozzle surface is arranged so as to face the medium supporting portion 21 of the platen 20 at a distance with a predetermined gap interposed therebetween. In the printer head 60, a concave shaped meniscus is formed at a distal end of the nozzle by a surface tension of ink, so that the balance between the internal pressure of the printer head and the atmospheric air pressure is maintained and hence a state in which ink is normally discharged is achieved. The state of driving of the printer head 60 (a method of discharging ink fine particles) may be either a thermal system or piezoelectric system.

Demountably mounted on the back side of the frame 10 are ink tanks 70 each having ink of an amount corresponding to an ink consumption amount per unit time in the printer apparatus P, and the ink tank 70 and the printer head 60 communicate with each other via ink tubes 71 and infusion pumps (not shown) on the color to color basis. The ink stored in each of the ink tanks 70 is configured to be sucked via the infusion pump and supplied to the printer head 60 via the ink tube 71. When the ink is supplied from the ink tank 70, the printer head 60 discharges ink from the nozzle by a particle diameter and a velocity according to a drive signal (discharge waveform) output from the control unit 80.

The control unit 80 includes a ROM in which a control program that controls operations of respective parts of the printer apparatus P, a RAM configured to store a printing program for drawing on the printing medium M temporarily therein, a CPU (arithmetic processing unit) configured to perform arithmetic processing on the basis of a printing program read from the RAM or an operation signal or the like input from an operating panel 88 and control operations of respective portions according to the control program, and the operating panel 88 including a display panel configured to display an operating state or the like of the printer apparatus P and various operation switches, and is configured to control a fore-and-aft movement of the printing medium M by the medium moving mechanism 30, a lateral movement of the carriage 40 by the carriage moving mechanism 50, a supply of ink by the ink tank 70, and a discharge of ink from the nozzle of the printer head 60.

For example, in a case where the drawing on the printing medium M is performed on the basis of the printing program read into the control unit 80, the fore-and-aft movement of the printing medium M by the medium moving mechanism 30 and the lateral movement (reciprocal motion) of the carriage 40 by the carriage moving mechanism 50 are combined to move the printing medium M and the printer head 60 with respect to each other, and ink is discharged from the respective printer heads 60 onto the printing medium M to draw information according to the printing program.

The operation of the carriage 40 at this time will be described with additional reference to an action graph shown in FIG. 4. In the drawing, the vertical axis indicates the velocity of movement of the carriage 40, the lateral axis indicates the elapse of time, and the inclination of the graph indicates the velocity of acceleration and deceleration of the carriage 40.

Figure 4:
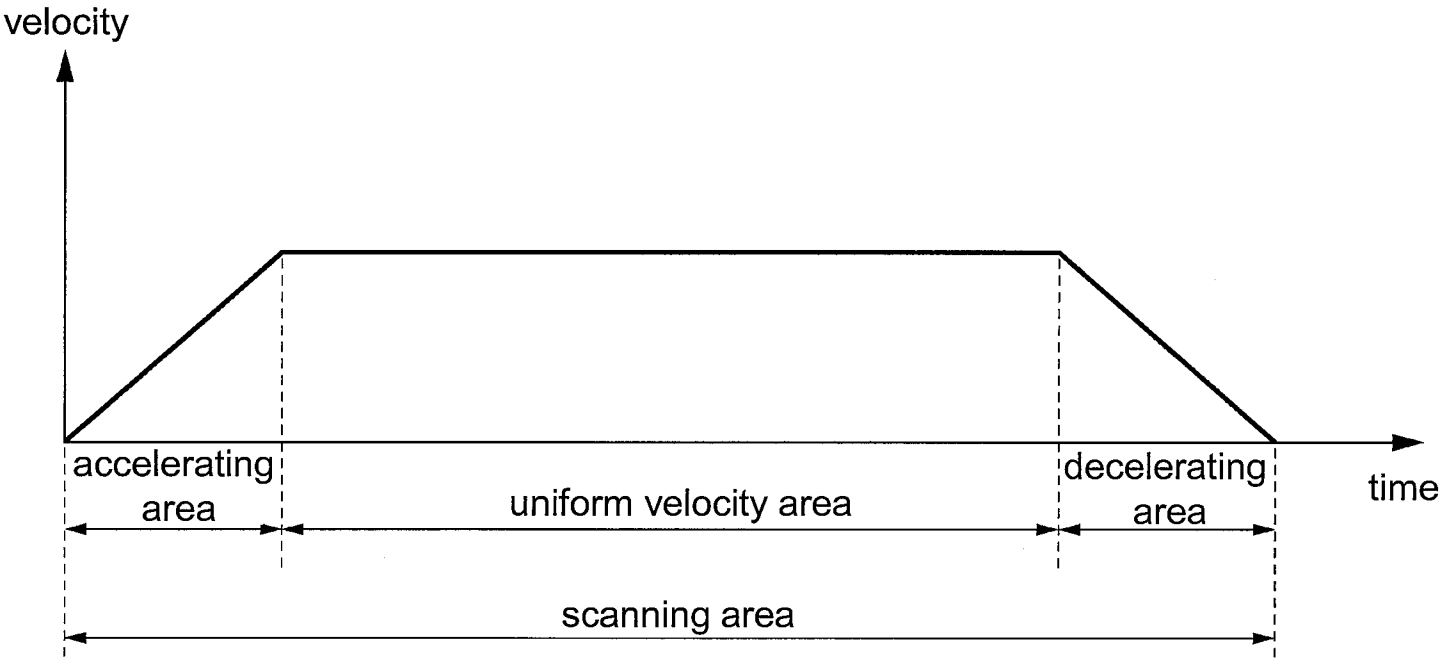
FIG. 4 is a drawing showing an action graph of a carriage.

The scanning area of the carriage 40 is roughly divided into three areas of an accelerating area, a uniform velocity area, and a decelerating area as shown in FIG. 4. The accelerating area is an area from when the carriage 40 starts movement (acceleration) until the velocity of movement of the carriage 40 reaches the reference velocity for the printing operation by the printer head 60. The uniform velocity area is an area in which the printer head 60 draws information according to the printing program on the printing medium M while the carriage 40 moves at a constant reference velocity (uniform speed). The reason when the carriage 40 is moved at the uniform speed in this manner, the ink droplets can be landed at desired positions of the printing medium M accurately by stabilizing flying shots discharged from the respective nozzles of the printer heads 60 onto the printing medium M. The decelerating area is an area from when the printing operation by the printer head 60 is ended and the velocity of movement of the carriage 40 is decelerated until the operation is stopped temporarily (until the acceleration in the opposite direction is started). In FIG. 4, although only the velocity change relating to the scanning movement of one way of the carriage 40 is shown, the reciprocal motion of the carriage 40 is achieved actually by continuously repeating the movement of the carriage 40 while switching the direction of movement between the left and right in sequence. Therefore, the left and right ends of the scanning area correspond to turning points of the carriage 40, and the carriage 40 is accelerated or decelerated before and after these turning points.

Figure 5:
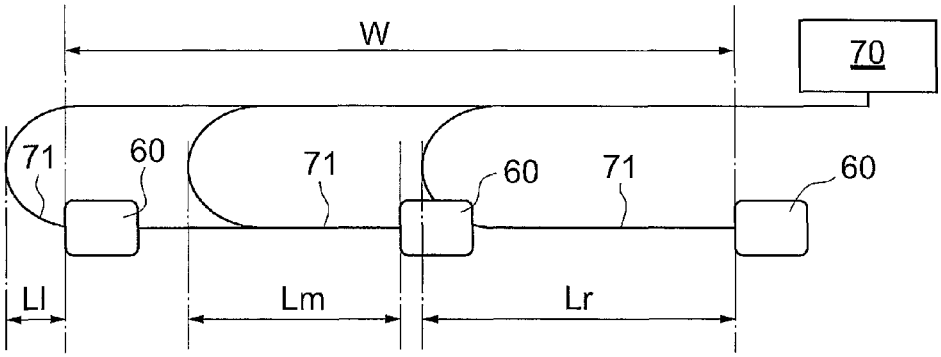
FIG. 5 is a schematic explanatory drawing showing states of an ink tube changed according to the movement of a printer head.

A case where the printer head 60 is integrally held by the carriage 40 which moves reciprocally in this scanning area, and the printer head 60 and the ink tube 71 connected to the printer head 60 is accelerated and decelerated together with the carriage 40 in the scanning area will be described with additionally reference to FIG. 5. In FIG. 5, cases where the printer head 60 is at a turning point at the left end, at a center point, and at a turning point at a right end will be described in the scanning area are illustrated.

The ink tube 71 is held in a state of being covered with a cable holding member, for example, not illustrated, extends leftward from the ink tank 70, is turned backward in a U-shape, and is connected to an ink supply chamber (not shown) in the printer head 60. Therefore, when the carriage 40 is reciprocally moved along the guide rail 45, the ink tube 71 does not come into contact with components such as the guide rail 45 or the like. Although the entire length itself of the ink tube 71 disposed in this manner is always constant, the length L of a portion of the ink tube 71 moving leftward and rightward together with the printer head 60 changes with the position of the printer head 60. Here, the entire length of the above-described scanning area corresponds to a one-way movement distance (maximum width of movement) W of the printer head 60, and the lengths of the ink tube 71 when the printer head 60 is positioned at a left end, at a center, and at a right end of the scanning area may be simply expressed by the following expressions (1) to (3).

$$L1=K \tag{1}$$

$$Lm=W/4+K \tag{2}$$

$$Lr=W/2+K \tag{3}$$

The amount of ink accumulated in a portion of the ink tube 71 (the portion of the length L) which is subjected to the reciprocal motion together with the printer head 60 is obtained by multiplying the length L of the ink tube 71 by the inner diameter of the ink tube 71. Now, when the carriage 40 decelerates when moving rightward in the scanning area, the ink accumulated in the ink tube 71 tries to continue the rightward movement in accordance with the inertial law (by an inertial force acted on itself). Accordingly, since a large amount of ink in the ink tube 71 flows toward the printer head 60 (rightward in FIG. 5), the internal pressure in the printer head 60 varies in the pressure-applying direction, a meniscus of ink formed at a nozzle position of the printer head 60 is broken, so that a phenomenon that ink is discharged from the nozzle and drops on the printing medium (so called, ink dripping phenomenon) occurs.

In addition, when the carriage 40 is accelerated leftward, a inertial force acts in the direction of causing ink to be remained (rightward), if the velocity of acceleration exceeds the predetermined value, the ink dripping phenomenon, that is, a phenomenon that the ink discharges from the nozzle occurs in the same manner as described above.

In contrast, when the carriage 40 is decelerated when moving leftward, or when the carriage 40 is accelerated rightward in FIG. 5, since all of the directions of inertial force acting on the ink is directions in which the ink is sucked from the nozzle (leftward which corresponds to the direction of reverse flow of ink), the internal pressure of the printer head 60 varies in the depressurizing direction. When the meniscus of the ink formed at the nozzle position is broken, air bubbles enters the interior of the nozzle and a phenomenon which disables ink discharge (so called, "ink undischarged phenomenon") occurs.

Accordingly, in order to correct the problem as described above, the printer apparatus P according to the embodiment includes a damper apparatus at a midpoint of an ink flow channel (ink tube 71) which connects the ink tank 70 and the printer head 60. The damper apparatus is disposed one by one in each of the ink tubes 71 of the respective colors, there are four of the damper apparatuses in this embodiment, and the configuration of these four damper apparatuses are all the same. The damper apparatus mounted on the printer apparatus P will be described below.

Figure 6:
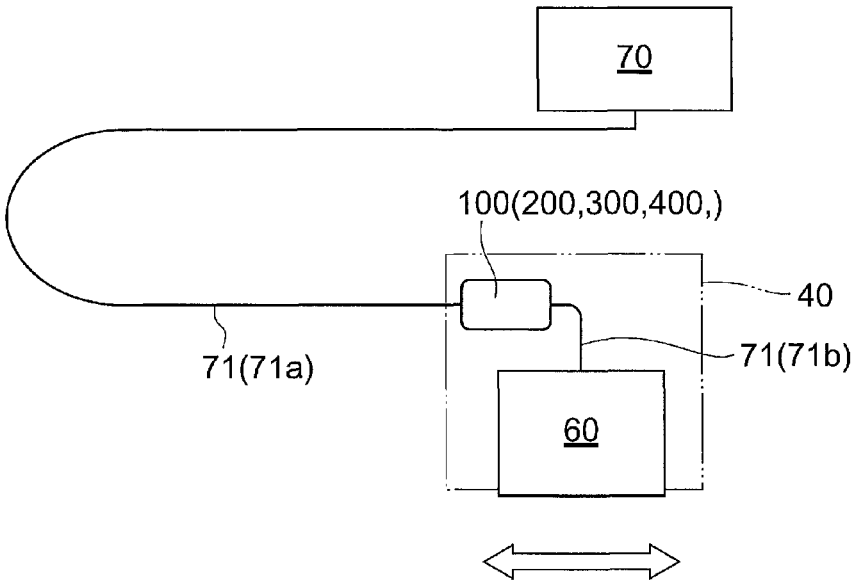
FIG. 6 is a schematic drawing showing an arrangement of a damper apparatus in the printer apparatus.
Figure 7A:
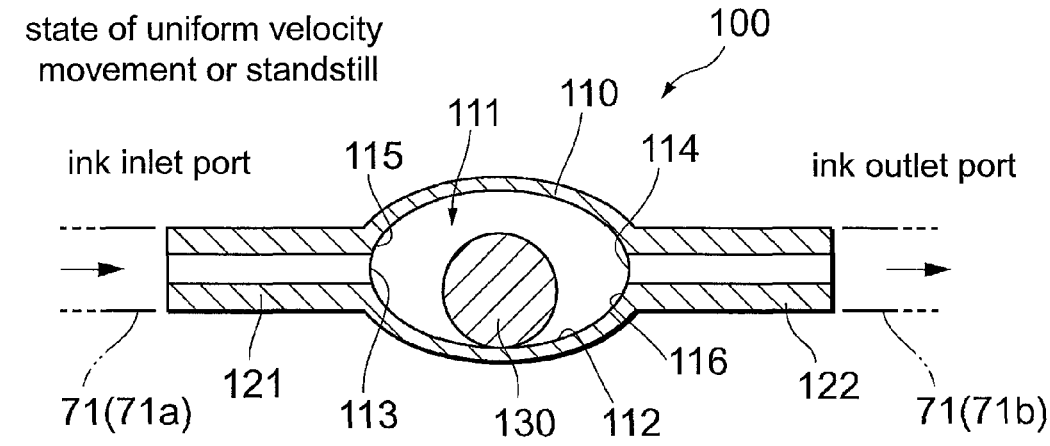
FIG. 7A is a cross-sectional side view of the damper apparatus showing a state of a constant velocity movement according to a first embodiment.
Figure 7B:
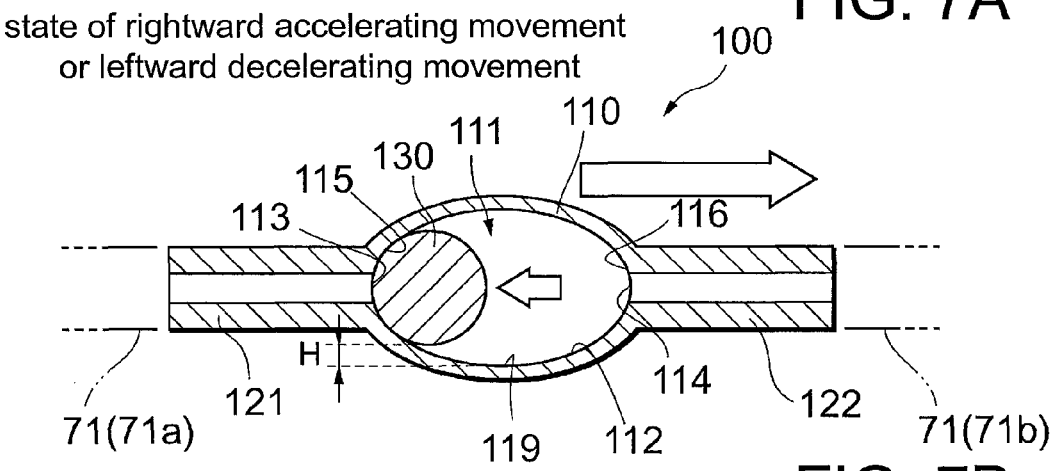
FIG. 7B is a cross-sectional side view of the damper apparatus showing a state of a rightward accelerating movement.
Figure 7C:
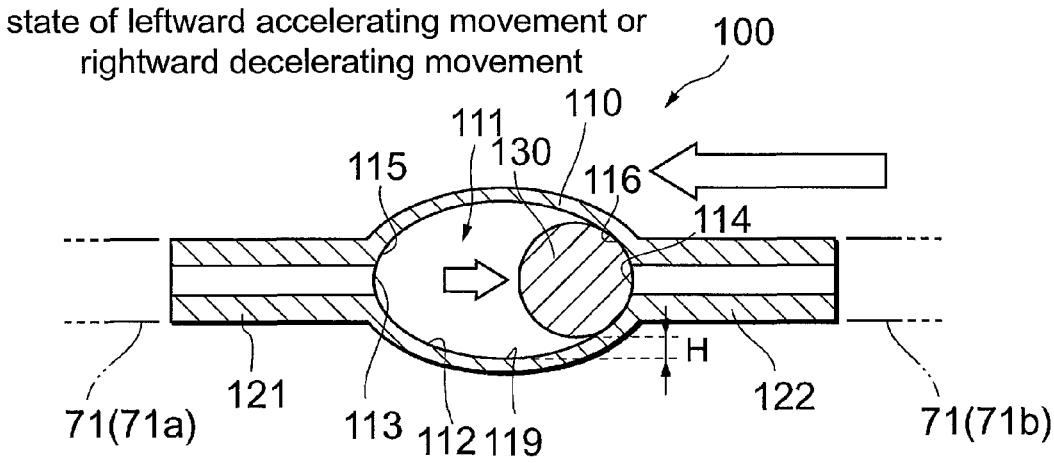
FIG. 7C is a cross-sectional side view of the damper apparatus showing a state of a leftward accelerating movement.

First of all, referring to FIG. 6 and FIGS. 7A to 7C, a damper apparatus 100 according to a first embodiment will be described. FIG. 6 illustrates a layout of the damper apparatus 100 in the printer apparatus P, and FIGS. 7A to 7C are cross-sectional side views of the damper apparatus 100. In FIG. 6, only one of the four damper apparatuses 100 is illustrated, and the carriage 40 is imaginarily illustrated using a double-dashed chain line.

The damper apparatus 100 includes a housing 110 provided at a midpoint of the ink tube 71 in a horizontal posture and a spherical valve body 130 stored in the housing 110, and is integrally held in the carriage 40 together with the printer head 60. In the following description, the left side of the damper apparatus 100 in FIGS. 7A to 7C is referred to as "upstream side" which communicates with the ink tank 70 and the right side is referred to as "downstream side" which communicates with the printer head 60 in the description.

The housing 110 is formed into a hollow shape having a valve chamber 111, which also serves as an ink flow channel. The valve chamber 111 is defined by an inner peripheral wall of the housing 110 and has the shape of an oval sphere having a long axis in the direction of flow of the ink, is formed with an inlet port 113 on the upstream side above a bottom surface 112 of the valve chamber 111, and is formed with an outlet port 114 on the downstream side opposing the inlet port 113. The ink tube 71 on the upstream side which is connected to the ink tank 70 (an upstream side tube 71*a*) is connected to the inlet port 113 via a connecting tube 121, and the ink tube 71 on the downstream side which is connected to the printer head 60 via a connecting tube 122 (a downstream side tube 71*b*) is connected to the outlet port 114, whereby an ink flow channel is also formed in the housing 110. The bottom surface 112 of the valve chamber 111 is formed with a curve which is depressed from the inlet port 113 and the outlet port 114 in an arcuate shape toward the center (a deepest portion 119) of the bottom surface 112, and peripheral edge portions of the respective ports 113 and 114 are formed with seating surfaces 115 and 116 for allowing the spherical valve body 130 to be seated thereon.

The spherical valve body 130 is a valve body which is a ball formed of stainless steel or the like, and is provided in a free state so as to be movable (capable of rolling) in the arbitrary direction in the valve chamber 111. Therefore, when the spherical valve body 130 is moved away from the seating surfaces 115 and 116, the spherical valve body 130 rests standstill on the bottom surface 112 (the deepest portion 119 at the center) of the valve chamber 111 under its own weight. Although the material of the spherical valve body 130 is not limited to the stainless steel, the material having a larger specific gravity than ink (for example, on the order of twice the specific gravity of ink) is preferable. This is for preventing the spherical valve body 130 from floating on the ink when the ink circulates in the valve chamber 111, and inhibiting the circulation of the ink, and also for allowing easy control of the movement of the spherical valve body 130 by the actions of the inertial force and the gravitational force as described later. The spherical valve body 130 has a diameter which cannot pass through the inlet port 113 and the outlet port 114 (that is, formed to have a larger diameter than the inner diameters of the respective ports 113 and 114), and when the spherical valve body 130 is relatively moved with respect to the housing 110 (along the bottom surface 112), the spherical valve body 130 may be seated on the seating surfaces 115 and 116 formed at the peripheral edges of the inlet ports 113 or the outlet port 114 to close the ports thereof.

As shown in FIGS. 7A to 7C, the damper tube assembly is constituted by connecting the ink tube 71 (the upstream side tube 71*a* and the downstream side tube 71*b*) via the connecting tubes 121 and 122 to both of the ports 113 and 114 of the damper apparatus 100 (this applies also to damper apparatuses in other embodiments described later).

The respective components of the printer apparatus P have been described thus far, and now an operating principle of the damper apparatus 100 at the time of printing will be described below.

First of all, when the carriage 40 is stopped, the damper apparatus 100 which moves integrally with the carriage 40 is also in the stopped state, and in this damper apparatus 100, the spherical valve body 130 rests standstill at a center position (the deepest portion 119) of the bottom surface 112 having the shape of the oval sphere in the valve chamber 111 of the housing 110. When the carriage 40 is moved at a constant reference velocity in the constant velocity area, that is, when the printing operation is performed by the printer head 60, the spherical valve body 130 moves with the housing 110 integrally at the same speed, and the force which moves relatively with respect to the housing 110 does not act on the spherical valve body 130. Therefore, in this case as well, the spherical valve body 130 rests standstill on the bottom surface 112 in the valve chamber 111. In a state in which the spherical valve body 130 rests standstill, the respective ports 113 and 114 of the valve chamber 111 are opened and the flow of the ink is not hindered. Therefore, the ink from the ink tube 71 on the upstream side can be supplied to the printer head 60 without any delay.

When the carriage 40 is accelerated rightward or decelerated leftward in the reciprocal motion of the carriage 40 and the velocity of acceleration or deceleration in the corresponding direction is generated on the damper apparatus 100 mounted integrally on the carriage 40, an inertial force is applied on the spherical valve body 130 toward the inlet port 113 side (leftward) in the valve chamber 111 of the damper apparatus 100. At this time, since the spherical valve body 130 tries to maintain the position thereof according to the inertial low, when observing this state from the outside of the housing 110, the spherical valve body 130 seems to move relatively to the position of the seating surface 115 of the inlet port 113 which is located above by a height h along the bottom surface 112 of the spherical valve body 130, thereby closing the inlet port 113.

Here, an inertial force F applied to the spherical valve body 130 may be expressed by the following expression (4)

$$F=m\times\alpha \tag{4}$$

where m is the mass of the spherical valve body 130 and α is a velocity of acceleration or deceleration of the carriage 40.

In this manner, when the carriage 40 is accelerated rightward or decelerated leftward, the inertial force toward the upstream side (leftward) acts also on the ink in the ink tube 71 and hence the ink makes an attempt to flow in the direction to decompress the pressurized state in the printer head 60. However, since the inlet port 113 is closed by the spherical valve body 130, the pressure variations in the printer head 60 is inhibited, and hence the ink undischarged phenomenon is prevented.

In contrast, when the carriage 40 is accelerated leftward or decelerated rightward in the reciprocal motion of the carriage 40 and the velocity of acceleration or deceleration in the corresponding direction is generated on the damper apparatus 100 mounted integrally on the carriage 40, an inertia force acts on the spherical valve body 130 toward the outlet port 114 (rightward) in the valve chamber 111 of the damper apparatus 100. At this time as well, the spherical valve body 130 tries to maintain the position thereof according to the inertial low, and the spherical valve body 130 seems to move relatively to the position of the seating surface 116 of outlet port 114 which is located above by the height h along the bottom surface 112, thereby closing the outlet port 114.

In this manner, when the carriage 40 is accelerated leftward or decelerated rightward, the inertial force toward the downstream side (rightward) acts also on the ink in the ink tube 71 and hence the ink makes an attempt to flow in the direction to compress the pressurized state in the printer head 60. However, since the outlet port 114 is closed by the spherical valve body 130, the pressure variations in the printer head 60 is inhibited, and hence the ink dripping phenomenon is prevented.

When the carriage 40 is moved from the accelerating and decelerating areas as described above to the constant velocity area and no inertial force acts on the spherical valve body 130 any longer (or when the inertial force is reduced to value smaller than a predetermined value), the spherical valve body 130 moves away from the seating surfaces 115 and 116 under its own weight, rolls downward along the bottom surface 112 of the valve chamber 111 and performs several damping motions leftward and rightward, and then finally rests standstill at the center position (the deepest portion 119) of the bottom surface 112. Therefore, at the time of printing operations by the printer head 60, ink from the ink tank 70 can be supplied adequately to the interior of the printer head 60 without hindering the flow of ink by the spherical valve body 130 in the housing 110. When the carriage 40 moves in the constant velocity area, the spherical valve body 130 does not necessarily have to rest completely standstill on the bottom surface, and may perform a damping motion (reciprocal motion in the lateral direction) on the bottom surface 112 to an extent that does not close the respective ports 113 and 114 (to an extent which does not impair the flow of ink).

When stopping the carriage 40 at the time when the operation of the printer apparatus P is stopped or the printing operation is terminated, an inertial force acts on the spherical valve body 130 by the deceleration in association of the stoppage, so that closure of the ink flow channel is adequately achieved in this case as well.

Therefore, according to the printer apparatus P in the embodiment described above, the damper apparatus 100 which moves integrally with the carriage 40 together with the printer head 60 and the ink tube 71 is provided at a midpoint of the ink tube 71 which connects the ink tank 70 and the printer head 60 to cause the spherical valve body 130 of the damper apparatus 100 to sense the velocity of acceleration and deceleration generated in association with the reciprocal motion of the carriage 40 and, when the carriage 40 is in acceleration or deceleration, the spherical valve body 130 rolls along the bottom surface 112 of the valve chamber 111 in accordance with the inertial law and selectively seats on the seating surfaces 115 and 116 of the inlet port 113 or the outlet port 114 depending on the direction of the inertial force to close the ink flow channel, so that the pressure variations in the printer head 60 is inhibited, and the ink dripping phenomenon and the ink undischarged phenomenon may be prevented.

In contrast, when the printing operation is performed by the printer head 60, that is, when the carriage 40 is moved at a uniform velocity (not in accelerated and decelerated), the spherical valve body 130 rolls downward on the bottom surface 112 of the valve chamber 111 by the action of the gravitational force to a position which does not close the inlet port 113 and the outlet port 114 and opens the ink flow channel. Therefore, the ink from the ink tank 70 can be supplied to the printer head 60 without delay according to the discharge of ink.

Also, since the ink flow channel can be opened and closed with a simple structure in which the spherical valve body 130 is rolled between the respective ports 113 and 114 and the deepest portion 119 by the inertial force or under its own weight and is seated on the seating surfaces 115 and 116 or is moved away therefrom, reduction of the number of components, reduction in size and weight, and cost reduction are achieved.

Incidentally, a maximum height Hmax which can move the spherical valve body 130 relatively upward in the valve chamber 111 by the inertial force acting on the spherical valve body 130 in association with the acceleration and deceleration of the carriage 40 can be obtained by the expression (5) shown below, $$H\max=V^2/2\alpha \tag{5}$$

from the relation between the positional energy and the kinetic energy underlying in the spherical valve body 130, where V is a velocity of movement of the carriage 40 and α is the velocity of acceleration and deceleration of the carriage 40. Here, when the velocity of acceleration and deceleration α is set to be approximately 1 G (=9.8 [m/sec$^2$]) and the velocity of movement V of the carriage 40 is set to be 1 [m/sec], from the expression (5), $H$max=0.05 m=50 mm is established.

In other words, this equation indicates that the spherical valve body 130 is capable of being moved relatively upward in the valve chamber 111 by 50 mm at maximum under the scanning condition of the carriage 40 described above. In the actual operation, the smaller diameter is preferable for the spherical valve body 130 in order to reduce the resistance with respect to the flow of the ink and the delay of the response (reaction time) of the spherical valve body 130, while in order to prevent the erroneous operation, the shape and the dimensions of the housing 110 (the valve chamber 111) is preferably determined by setting the maximum height Hmax to a value in the range from 0.5 to 5.0 [mm] under the above-described scanning condition.

By the inertial force acting on the spherical valve body 130 in this manner, the spherical valve body 130 is seated on the seating surfaces 115 and 116 of the respective ports 113 and 114 and closes the ink flow channel. However, since inertial forces also acts on the ink tube 71 and the ink itself which is accumulated in the housing 110 as described above, the spherical valve body 130 receives not only the inertial force of itself, but also a fluid force of ink (the inertial force acting on the ink) as a back pressure, and moves toward the seating surface 115 or the seating surface 116. In addition, in association with the ink flow, since a negative pressure is generated in the vicinity of the ports 113 and 114 that the spherical valve body 130 makes an attempt to close, the spherical valve body 130 is moved so as to be sucked toward the ports 113 and 114. The spherical valve body 130 is configured to be seated correctly on the seating surfaces 115 and 116 with this synergetic effect.

Figure 8:
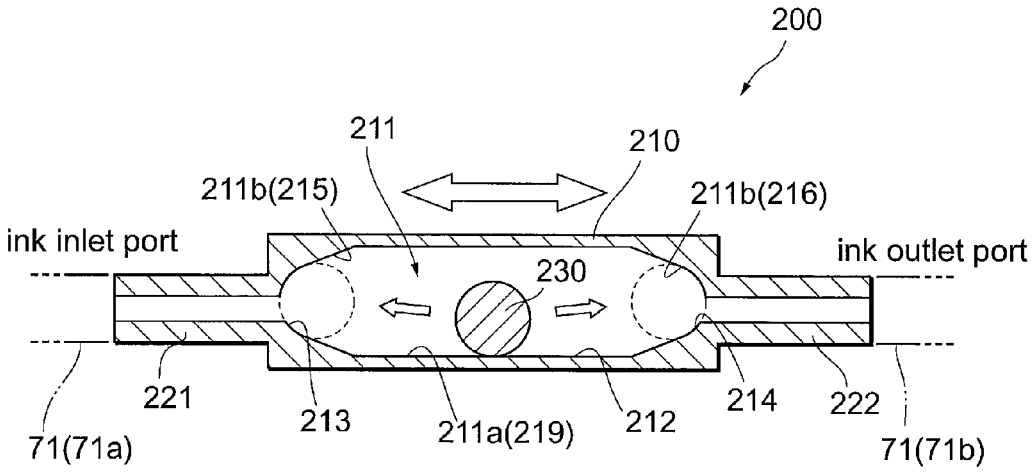
FIG. 8 is a cross-sectional side view of the damper apparatus according to a second embodiment.

Referring now to FIG. 8, a damper apparatus 200 according to a second embodiment will be described. In the following description, the same components as those in the printer apparatus P described above are designated by the same reference numerals and the description will be omitted. FIG. 8 is a cross-sectional side view of the damper apparatus 200.

The damper apparatus 200 includes a substantially hollow cylindrical housing 210 provided in the ink tube 71 via left and right connecting tubes 221 and 222, and a spherical valve body 230 stored in the housing 210. In the damper apparatus 200 in the second embodiment, mainly a configuration of the housing 210 is different from the damper apparatus 100 in the first embodiment.

The housing 210 includes a valve chamber 211 which is partitioned by an inner peripheral wall of the housing 210, and serves as an ink flow channel. The valve chamber 211 has a conical surface 211*b* which defines a channel having a substantially circular cross section and is reduced gradually in inner diameter from a cylindrical surface 211*a* at a center toward respective ports 213 and 214, and the conical surface 211*b* serves also as seating surfaces 215 and 216 for allowing the spherical valve body 230 to seat thereon.

In the damper apparatus 200, when the carriage 40 is not in acceleration or deceleration, the spherical valve body 230 rests standstill at the deepest portion 219 (on the cylindrical surface 211*a*) having a constant width on the bottom surface 212, and when the carriage 40 is accelerated and decelerated and the inertial force acts, the spherical valve body 230 climbs on an inclination of the conical surface 211*b* and is seated on the seating surfaces 215 and 216, so that the ink flow channel is closed.

In the damper apparatus 200 according to the second embodiment configured in this manner as well, when the carriage 40 is accelerated and decelerated, the spherical valve body 230 rolls along the bottom surface 212 of the valve chamber 211 in accordance with the inertial law and selectively seats on the seating surfaces 215 and 216 of the inlet port 213 or the outlet port 214 depending on the direction of the inertial force to close the ink flow channel, so that the pressure variations in the printer head 60 is inhibited, and the ink dripping phenomenon and the ink undischarged phenomenon may be prevented. In contrast, when the carriage 40 is not accelerated and decelerated, the spherical valve body 230 rolls downward on the bottom surface 212 of the valve chamber 211 by the action of the gravitational force to a position which does not close the inlet port 213 and the outlet port 214 and opens the ink flow channel. Therefore, the ink from the ink tank 70 can be supplied to the printer head 60 without delay according to the discharge of ink. Also, since the ink flow channel can be opened and closed with a simple structure in which the spherical valve body 230 is rolled between the respective ports 213 and 214 and the deepest portion 219 by the inertial force or under its own weight and is seated on the seating surfaces 215 and 216 or is moved away therefrom, reduction of the number of components, reduction in size and weight, and cost reduction are achieved.

Therefore, the same effect as in the damper apparatus 100 according to the first embodiment described above is obtained. However, the damper apparatus 200 according to the second embodiment is characterized in that the spherical valve body 230 which reaches positions in the vicinity of the ports 213 and 214 can be seated on the seating surfaces 215 and 216 smoothly and stably because the conical surface 211*b* for guiding the spherical valve body 230 from the deepest portion 219 on the bottom surface 212 toward the respective ports 213 and 214 also serves as a seating surface.

Figure 9A:
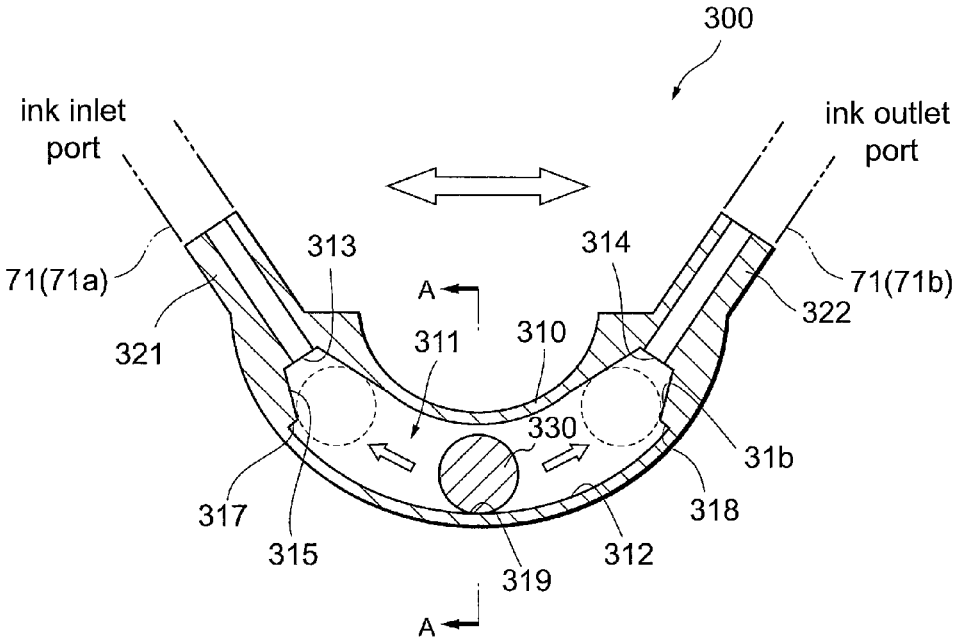
FIG. 9A is a cross-sectional side view of the damper apparatus according to a third embodiment.
Figure 9B:
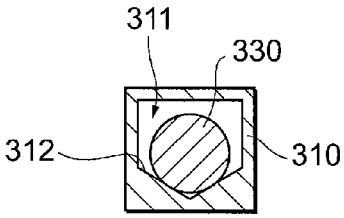
FIG. 9B is a cross-sectional view taken along the line A-A in FIG. 9A.

Referring now to FIGS. 9A and 9B, a damper apparatus 300 according to a third embodiment will be described. In the following description, the same components as those in the printer apparatus P described above are designated by the same reference numerals and the description will be omitted. Here, FIG. 9A is a cross-sectional side view of the damper apparatus 300, and FIG. 9B is a cross-sectional view taken along the line indicated by arrows A-A in FIG. 9A.

The damper apparatus 300 includes a housing 310 provided in the ink tube 71 via left and right connecting tubes 321 and 322 extending obliquely upward, and a spherical valve body 330 stored in the housing 310. In the damper apparatus 300 in this embodiment, mainly a configuration of the housing 310 is different from the damper apparatus 100 in the first embodiment.

The housing 310 has a substantially rectangular tubular shape bent into an U-shape, and is formed with a valve chamber 311 which is partitioned by an inner peripheral wall of the housing 310, and serves as an ink flow channel. In this valve chamber 311, a center portion between an inlet port 313 and an outlet port 314 corresponds to a deepest portion 319, and a bottom surface 312 extends from the deepest portion 319 upward in an arcuate shape toward the respective ports 313 and 314. The valve chamber 311 is formed with conical-shaped seating surfaces 315 and 316 each having an inner diameter decreasing gradually toward the respective ports 313 and 314 at both ends thereof. Since shoulders 317 and 318 are formed between the seating surfaces 315 and 316 and the bottom surface 312, so that the movement of the spherical valve body 330 is restricted by coming into abutment with the shoulders 317 and 318 when an inertial force (and a fluid force from the ink) equal to or higher than the predetermine threshold valve does not act on the spherical valve body 330. Therefore, the problem such that the spherical valve body 330 closes the ink flow channel by an erroneous operation is prevented. Also, as shown in FIG. 9B, the bottom surface 312 of the valve chamber 311 has a groove portion opened upward in a V-shape to reduce the contact surface area between the spherical valve body 330 and the bottom surface 312, and sideward displacement of the spherical valve body 330 (the direction orthogonal to the paper plane) is prevented.

In the damper apparatus 300, when the carriage 40 is not in acceleration or deceleration, the spherical valve body 330 rests standstill at the deepest portion 319 of the bottom surface 312, and when the carriage 40 is accelerated and decelerated and the inertial force acts, the spherical valve body 330 climbs on an arcuate curve and is seated on the seating surfaces 315 and 316, so that the ink flow channel is closed.

In the damper apparatus according to the third embodiment configured in this manner as well, when the carriage 40 is accelerated and decelerated, the spherical valve body 330 rolls along the bottom surface 312 of the valve chamber 311 in accordance with the inertial law and are selectively seated on the seating surfaces 315 and 316 of the inlet port 313 or the outlet port 314 depending on the direction of the inertial force to close the ink flow channel, so that the pressure variations in the printer head 60 is inhibited, and the ink dripping phenomenon and the ink undischarged phenomenon may be prevented. In contrast, when the carriage 40 is not accelerated and decelerated, the spherical valve body 330 rolls downward on the bottom surface 312 of the valve chamber 311 by the action of the gravitational force to a position which does not close the inlet port 313 and the outlet port 314 and opens the ink flow channel. Therefore, the ink from the ink tank 70 can be supplied to the printer head 60 without delay according to the discharge of ink. Also, since the ink flow channel can be opened and closed with a simple structure in which the spherical valve body 330 is rolled between the respective ports 313 and 314 and the deepest portion 319 by the inertial force or under its own weight and is seated on the seating surfaces 315 and 316 or is moved away therefrom, reduction in number of components, reduction in size and weight, and cost reduction are achieved.

Therefore, the same effects as the damper apparatus 100 in the first embodiment described above are obtained. However, the damper apparatus 300 according to the third embodiment is characterized in that the position of start of the operation of the spherical valve body 330 is always the same, and the lateral displacement is also inhibited by the V-shaped grove portion of the bottom surface 312 and hence variations in the operating time of the spherical valve body 330 is reduced. Since the erroneous operation of the spherical valve body 330 is prevented by the shoulders 317 and 318 provided at a boundary between the seating surfaces 315 and 316 and the bottom surface 312, the reliability of the damping function (pressure inhibiting function) can further be improved in the damper apparatus 300.

Figure 10:
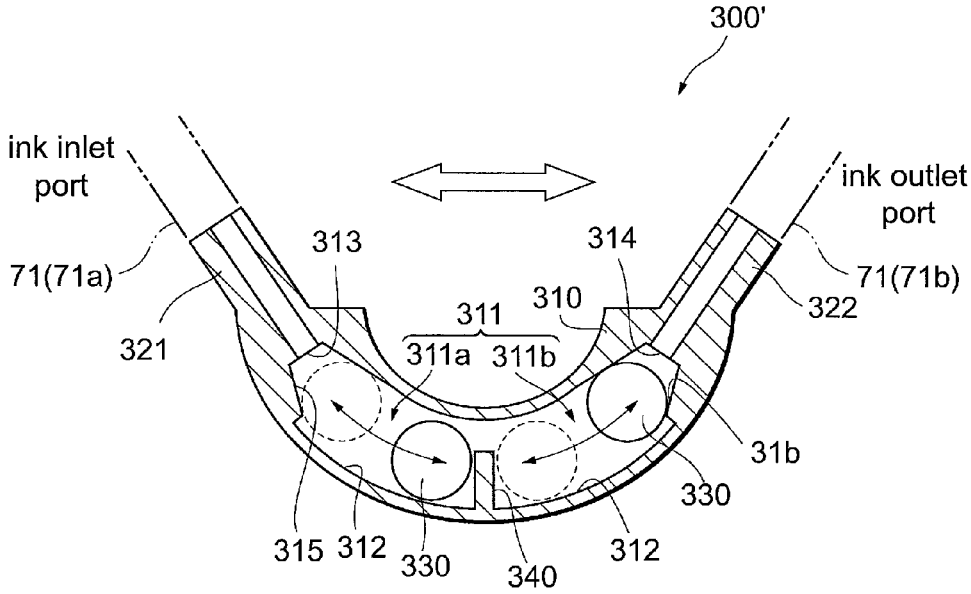
FIG. 10 is a cross-sectional side view showing the damper apparatus according to a modification of the third embodiment.

FIG. 10 shows a modification of the damper apparatus 300 in the third embodiment. A damper apparatus 300' is different from the damper apparatus 300 described above in that two of the spherical valve bodies 330 are stored in the housing 310, and in that a partitioning portion 340 is formed so as to project at a center portion of the bottom surface 312. In the damper apparatus 300', the valve chamber 311 is divided into substantially halves on the left and right by the partitioning portion 340 to define an inlet-side valve chamber 311*a* and an exit-side valve chamber 311*b*, and one each of the spherical valve bodies 330 is stored in the inlet-side valve chamber 311*a* and the exit-side valve chamber 311*b*. In the valve chamber 311, the upper portion of the partitioning portion 340 is opened to serve as a communication channel between the inlet-side valve chamber 311*a* and the exit-side valve chamber 311*b*. Therefore, the flow of ink is not impaired by the formation of the partitioning portion 340. Therefore, the damper apparatus 300' in this configuration is characterized in that the spherical valve bodies 330 can be operated independently in the respective valve chambers 311*a* and 311*b*, the response for opening and closing the ink flow channel can further be improved. Also, in a case where the fluid pressure (back pressure) that the spherical valve bodies 330 receive from ink in the interior of the housing 310 when the spherical valve bodies 330 is seated on the seating surface 315 or the seating surface 316 is different between the inlet-port side and the outlet-port side, the shapes of the seating surfaces 315 and 316 may be differentiated between the inlet-port side and the outlet-port side, so that the spherical valve bodies 330 and the seating surfaces 315 and 316 are configured to come into abutment respectively with the seats at an adequate pressure.

Figure 11:
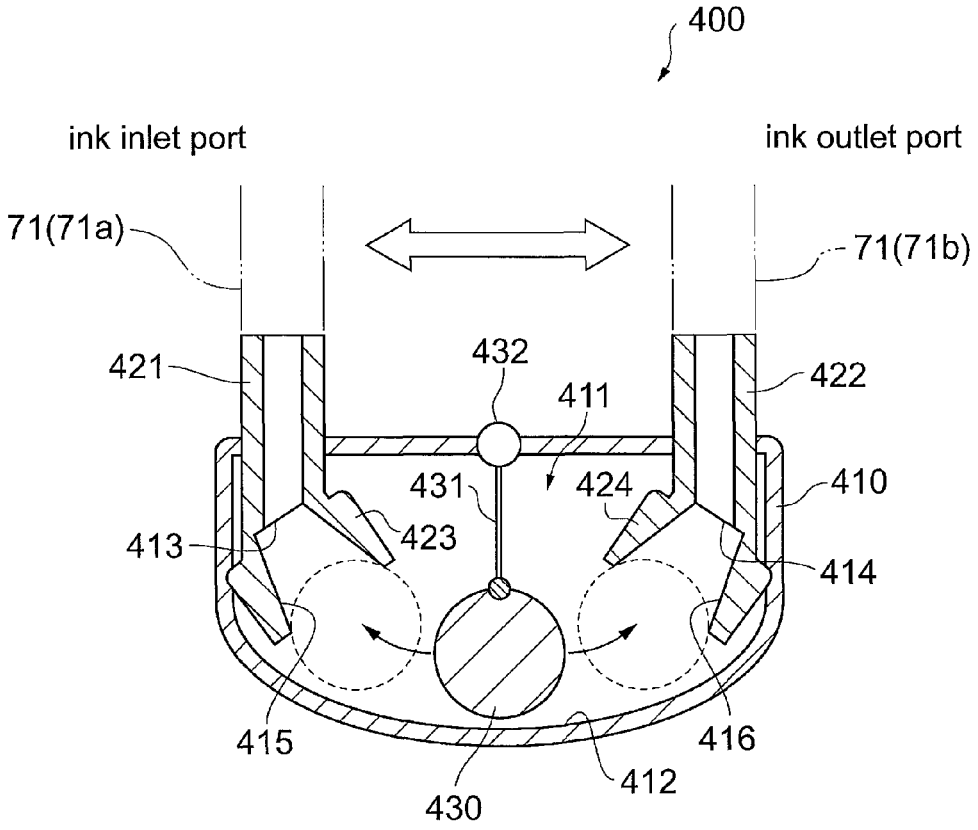
FIG. 11 is a cross-sectional side view of the damper apparatus according to a fourth embodiment.

Referring now to FIG. 11, a damper apparatus 400 according to a fourth embodiment will be described. In the following description, the same components as those in the printer apparatus P described above are designated by the same reference numerals and the description will be omitted. FIG. 11 is a cross-sectional side view of the damper apparatus 400.

The damper apparatus 400 includes a sealed container-shaped housing 410 provided in the ink tube 71 via left and right connecting tubes 421 and 422 extending in the perpendicular direction, and a spherical valve body 430 suspended so as to be swingable in the arbitrary direction by a supporting member 431 hung from a center of a top surface of a valve chamber 411 of the housing 410 via a supporting shaft 432, whereby a pendulum is configured by the spherical valve body 430 and the supporting member 431. Examples of the supporting member 431 which supports the spherical valve body 430 include a flexible wire member such as a wire or a non-flexible rod-shaped member.

The respective connecting tubes 421 and 422 are held in an upright position in the housing 410, and the connecting tubes 421 and 422 are integrally provided with substantially cylindrical ball receiving members 423 and 424 having respective ports 413 and 414 at terminals thereof. Formed on inner peripheral walls of the ball receiving members 423 and 424 are conical shaped seating surfaces 415 and 416 for causing the spherical valve body 430 to be seated thereon. A bottom surface 412 of the valve chamber 411 is curved in an arcuate shape so as to follow the swinging trajectory of the pendulum (the spherical valve body 430).

In the damper apparatus 400, when the carriage 40 is not in acceleration or deceleration, the spherical valve body 430 rests standstill in the suspended state, and when the carriage 40 is accelerated and decelerated and the inertial force acts, the spherical valve body 430 performs a pendulum motion between the inlet port 413 and the outlet port 414 by the inertial force and is seated on the seating surface 415 or 416, so that the ink flow channel is closed.

In the damper apparatus 400 according to the fourth embodiment configured in this manner as well, when the carriage 40 is accelerated and decelerated, the spherical valve body 430 performs a pendulum motion in the valve chamber 411 in accordance with the inertial law and selectively seats on the seating surfaces 415 and 416 of the inlet port 413 or the outlet port 414 depending on the direction of the inertial force to close the ink flow channel, so that the pressure variations in the printer head 60 is inhibited, and the ink dripping phenomenon and the ink undischarged phenomenon may be prevented. In contrast, when the carriage 40 is not accelerated and decelerated, the spherical valve body 430 rests standstill in the suspended state in the valve chamber 311 by the action of the gravitational force to open the ink flow channel. Therefore, the ink from the ink tank 70 can be supplied to the printer head 60 without delay according to the discharge of ink. Also, since the ink flow channel can be opened and closed with a simple structure in which the spherical valve body 430 is brought into a pendulum motion between the respective ports 413 and 414 to be seated on or moved away from the seating surfaces 415 and 416, reduction of the number of components, reduction in size and weight, and cost reduction are achieved.

Therefore, the same effect as in the damper apparatus 100 according to the first embodiment described above is obtained. However, the damper apparatus 400 according to the fourth embodiment is characterized in that since the spherical valve body 430 needs not to be rolled on the bottom surface 412, the spherical valve body 430 is not subject to an abrasion caused by a contact with respect to the bottom surface 412, and occurrence of a seat-abutment failure of the spherical valve body 430 with respect to the seating surfaces 415 and 416 caused by the deformation due to an abrasion with time of the spherical valve body 430 is prevented.

As described thus far, the damper apparatuses 100 to 400 according to the embodiments, the damper tube assembly, and the printer apparatus P, prevention of the ink dripping phenomenon and the ink undischarged phenomenon are achieved by inhibiting the pressure variations in the printer head 60. Also, the more the velocity of acceleration and deceleration is increased, the larger inertial force acts, and hence the response of the spherical valve body is improved and the respective ports are firmly closed. Therefore, further increase in velocity of the reciprocal motion of the carriage 40, that is, the increase in velocity of printing is also possible.

Figure 12A:
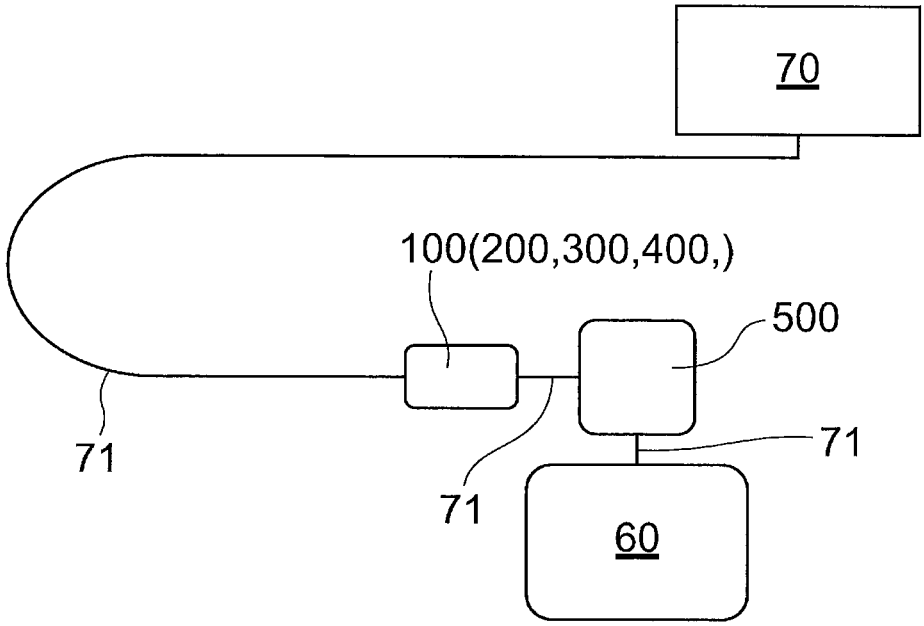
FIGS. 12A and 12B are schematic drawings each showing a different arrangement of the damper apparatus in the printer apparatus.
Figure 12B:
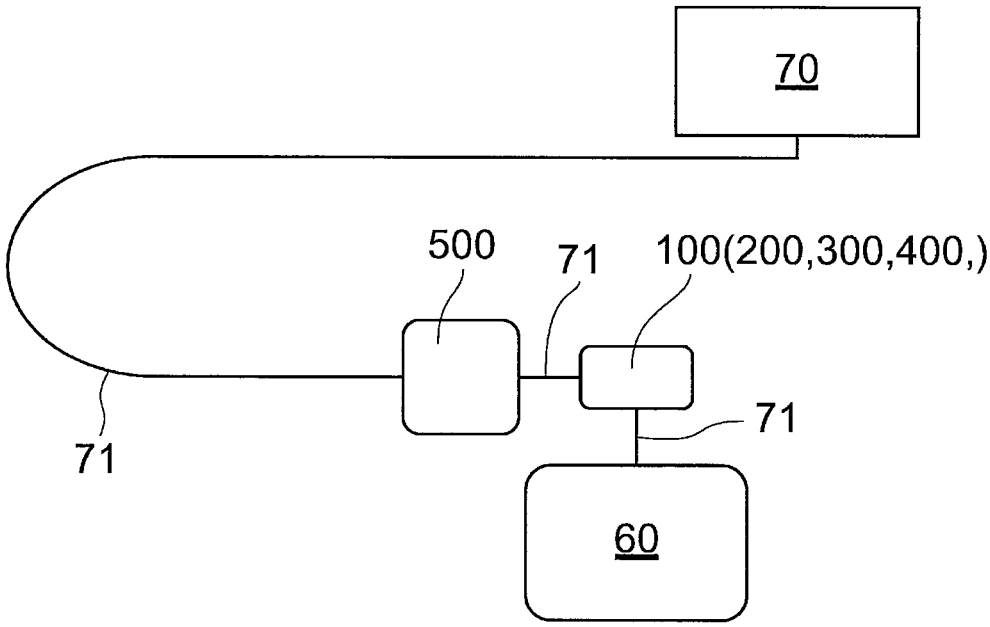

Although the preferred embodiments of the invention have been described thus far, the scope of the invention is not limited thereto. For example, as shown in FIGS. 12A and 12B, the damper apparatus 100 or the like according to the embodiments described above, and a damper apparatus 500 of other system may be provided at a midpoint of the ink tube 71 (the ink flow channel). As the damper apparatus 500 of other system, various types of known modes may be employed. For example, a configuration disclosed in JP-A-2009-178889 by the present applicant is also exemplified. At this time, the damper apparatus 100 or the like in the embodiment may be arranged on the upstream side as shown in FIG. 12A or on the downstream side as shown in FIG. 12B with respect to the damper apparatus 500 of other system.

It is also possible to provide an urging unit configured to urge the valve body always in the opening direction (valve opening direction) and, when the carriage 40 is not in acceleration or deceleration, move the valve body to a position opening the port by the action of the urging force and, when the carriage 40 is accelerated and decelerated, move the valve body to a position closing the port by the action of the inertial force. Examples of the urging unit include the spring member such as a coil spring, a torsion spring, a leaf spring, or a disc spring.

It is also possible to form the valve body of a magnetic member, turn an electromagnet ON to move the valve body to a position opening the port by a magnetic force (attracting force) of a magnet when the carriage 40 is not accelerated or decelerated by a magnet (for example, electromagnet or permanent magnet) disposed in the valve chamber or out of the valve chamber, and turn the electromagnet OFF to move the valve body to a position closing the port by the action of the inertial force when the carriage 40 is in acceleration or deceleration.

A configuration in which an acceleration detector (acceleration sensor) configured to detect the acceleration of the carriage 40 is mounted to activate an actuator when the acceleration of the carriage 40 exceeds a predetermined threshold value and add an urging force of the actuator to the valve body together with the inertia force is also applicable. A configuration in which an opening and closing member is provided separately in the valve chamber of the housing to activate the opening and closing member according to the acceleration detected by the acceleration detector to open and close the respective ports by the valve body and, synchronously the valve chamber is opened and closed by the opening and closing member is also applicable.

As described above, since the valve body may be swept away toward the respective ports by the flow of the ink itself associated with an inertial force acting on the ink in the ink tube 71 when the carriage 40 is accelerated and decelerated, the damper apparatus may be arranged at any position in the ink flow channel, whereby a predetermined damping effect is achieved. However, since the response is improved better by using the inertial force acting on the valve body itself by the synergetic effect, the damper apparatus is preferably arranged at any position on the carriage 40.

In the embodiments described above, a configuration in which the spherical valve body is formed as a stainless steel ball is exemplified. However, the invention is not limited thereto and, for example, the stainless steel ball may be coated with polyethylene or plastic such as fluorine contained resin or the like in order to avoid the contact between the stainless steel ball (metal) and ink. The spherical valve body may be a molded product formed by mixing metal with resin. In addition, the valve body does not have to be a spherical member as long as it meets the object to close the ink flow channel according to the action of inertia. Rotating members such as an oval spherical body or a cylindrical body, and polygonal column or polygonal pyramid are also applicable.

The shape of the seating surface for allowing the valve body to be seated is not limited to the oval spherical surface or the conical surface as exemplified in the embodiments described above and may be of any shape as long as the respective ports can be closed. Examples of the shape of the seating surface include a shape following the outline of the spherical valve body. The respective ports do not have to be closed completely by the valve body, and leakage may occur by an extent which does not vary the internal pressure of the printer head.

The cross-sectional shape of the valve chamber is not limited to a circular shape, an oval shape, and a square shape, and various shapes are applicable as long as the movement of the valve body is not impaired. For example, the circle is effective when increasing the velocity of response at the time of opening of the respective ports in comparison with the oval shape. Also, the inlet port side and the outlet port side may be formed into different shapes. For example, a configuration in which the shape on the inlet port side is formed into an oval shape and the shape on the outlet port side is formed into a circular shape is also applicable. Since only a curved surface or a tapered surface has to be formed on a lower side of the housing, a configuration in which the shape of the upper half of the housing is formed into a cubic shape and the shape on the lower half is formed into a spherical shape is also applicable.

In the above-described embodiment, the case where the damper apparatus illustrated in FIGS. 7A to 7C and FIG. 8, the case where the inlet port and the outlet port are arranged in the lateral direction are illustrated. However, the positions of mounting the respective ports are not limited as long as the port which needs to prevent an abrupt flow of ink in association with an acceleration change can be closed. For example, the flow of ink may be turned by approximately 90 degrees by positioning the inlet port on the left side and the outlet port on the upper side.

The types of ink include aqueous ink, oleosus ink, solvent ink, UV-cured ink, thermosetting ink, and the like and are not specifically limited. It is preferable to select the shape and material of the valve body according to the characteristics of the ink, whereby a change of properties of ink (a change of material values of ink) due to a contact between the ink and the valve body may be prevented. Also, the shape and the material of the valve body may be differentiated according to the characteristics depending on the ink colors.

Also, in the embodiments described above, the form of the ink tank 70 may be other forms such as a cylindrical container shape, or a flexible bag shape, and the position of disposition of the ink tank 70 may be selected appropriately such as a front side or above the apparatus body 1, or separately from the apparatus body 1. Also, a sub tank for ink may be provided between the ink tank 70 (main tank) and the printer head 60.

The positional relationship (head differential) between the ink tank 70 and the printer head 60 is not specifically limited and the damper apparatus is applied in a state of being set to an appropriate head differential. In particular, in order to form a meniscus on the nozzle surface desirably, the pressure in the printer head 60 inside the nozzle surface is preferably lower than the atmospheric pressure by arranging the ink tank 70 to a position lower than the printer head 60 (for example 5 to 10 [cm] lower) and generating a head differential.

In the embodiments shown above, the printer apparatus of an uniaxial printing medium movement type and an uniaxial printer head movement type has been described as an example of the ink jet printer to which the invention is applied. however, the invention may be applied to an ink jet printer of other types, for example, to an ink jet printer of a biaxial printer head moving type. In the case of the biaxial printer head moving type, the orientations of the damper apparatuses of the invention are preferably aligned with each of the corresponding directions of axes.

What is claimed is:

1. A damper apparatus provided at a midpoint of an ink flow channel connecting an ink tank having ink stored therein and a printer head and configured to open and close the ink flow channel in an ink jet printer having the printer head configured to discharge ink on a printing medium and a carriage configured to move reciprocally along a predetermined scanning direction, the damper apparatus comprising:

a housing having a valve chamber communicating with the ink flow channel in an interior of the housing and reciprocally moving integrally with the carriage;

an inlet port formed at one end portion of the housing and configured to communicate the ink flow channel on a side of the ink tank and the valve chamber;

an outlet port formed at an other end portion of the housing and configured to communicate the ink flow channel on a side of the printer head and the valve chamber; and a valve body configured to be stored so as to be relatively movable in the valve chamber, wherein the valve body moves relatively to a position for closing selectively the inlet port or the outlet port according to a direction of action of an inertial force upon reception of the inertial force in association with an acceleration and deceleration to close the ink flow channel when the carriage is accelerated or decelerated, and the valve body moves relatively to a position for opening selectively the inlet port or the outlet port under an own weight of the valve body to open the ink flow channel when the carriage is not accelerated and decelerated.

2. The damper apparatus according to claim 1, wherein a bottom surface of the valve chamber comprises a deepest portion below a center position between the inlet port and the outlet port and an inclination or a curve extending downward to the deepest portion from the inlet port and the outlet port, and the valve body is formed of a rotating member which is capable of rolling on the bottom surface.

3. The damper apparatus according to claim 1, wherein the valve body is hung from a top surface of the valve chamber in a suspended state so as to be swingable with a supporting member, and is configured to perform a pendulum motion upon reception of an action of an inertial force and a gravitational force in association with a reciprocal motion of the carriage, and the inlet port and the outlet port are arranged on a swinging trajectory of the valve body due to the pendulum motion.

4. A damper tube assembly comprising:

a damper apparatus according to claim 1 and at least one of an upstream side tube connected to the inlet port and capable of forming the ink flow channel on the side of the ink tank and a downstream side tube connected to the outlet port and capable of forming the ink flow channel on the side of the printer head.

5. An ink jet printer comprising:

a medium supporting portion configured to support a printing medium;

a carriage having a printer head configured to discharge ink;

a carriage moving mechanism configured to relatively move the carriage along a surface to be printed of the printing medium supported by the medium supporting portion;

an ink tank configured to store ink;

an ink tube configured to form an ink flow channel configured to connect the ink tank and the printer head; and the damper apparatus according to claim 1.

* * * * *